United States Patent [19]

Strate

[11] Patent Number: 4,747,792

[45] Date of Patent: May 31, 1988

[54] MULTI-POLE PLUG CONNECTOR WITH CODING SYSTEM

[75] Inventor: Klaus Strate, Detmold, Fed. Rep. of Germany

[73] Assignee: C.A. Weidmüller GmbH & Co, Detmold, Fed. Rep. of Germany

[21] Appl. No.: 21,414

[22] Filed: Mar. 4, 1987

[30] Foreign Application Priority Data

Mar. 5, 1986 [EP] European Pat. Off. ..... 86102927.0

[51] Int. Cl.[4] ..... H01R 13/645

[52] U.S. Cl. ..... 439/681

[58] Field of Search ..... 439/677, 680, 681

[56] References Cited

U.S. PATENT DOCUMENTS 3,399,374 7/1966 Pauza et al. ..... 439/355

FOREIGN PATENT DOCUMENTS 2807017 8/1979 Fed. Rep. of Germany .
3014804 10/1981 Fed. Rep. of Germany .
3417855 11/1985 Fed. Rep. of Germany .

*Primary Examiner*—Neil Abrams
*Attorney, Agent, or Firm*—Erwin S. Teltscher

[57] ABSTRACT

A multi-pole plug connector has a strip composed of a plurality of plug and socket parts, a plurality of corresponding socket and plug parts insertable into the strip; insertion recesses are provided on the plug parts and socket parts for insertion of coding elements, and contours are provided on the plug parts and socket parts in correspondence with a pattern having a predetermined pattern spacing and including a plurality of projections and recesses, while corner edges of the contours deviate from the patterned contours so as to purposely be mismatched and non-fittingly collidable with the latter.

7 Claims, 4 Drawing Sheets

MULTI-POLE PLUG CONNECTOR WITH CODING SYSTEM

BACKGROUND OF THE INVENTION

The present invention relates to a multi-pole plug connector.

More particularly, it relates to a multi-pole plug connector which has a strip composed of a plurality of plug parts or socket parts, and a plurality of corresponding socket parts or plug parts, with coding elements insertable in insertion recesses of the plug parts and socket parts.

Plug connectors of the above-mentioned general type are known in the art. The coding system in the known plug connectors includes the provision of receptacles on the plug parts, on one hand, and on the socket parts, on the other hand, and the receptacles are provided with the coding elements for the coding purposes. Different embodiments are known for the position of the receptacles and the type of the coding elements. They are disclosed , for example, in the German documents DE-B No. 28 07 017, DE-A No. 34 17 855, and DE-C 30 14 804. With the known coding systems, the plug and socket parts having equal respective numbers of poles can be coded. This type of coding is, however, problematic when it deals with long strips with a high total number of poles, and is composed of plug or socket parts arranged in a row and having different respective numbers of poles, wherein the coding can prevent the possibility of interengagement of plug parts and socket parts with non-equal number of poles. The problem is especially severe when relatively many parts with a lower number of poles, for example two- to three-pole parts are available, since then the total possible number of different coding combinations possible in the system is not achieved here. In this case alleviation is possible by introduction of the poles themselves into the coding system, which naturally leads to a loss of poles.

SUMMARY OF THE INVENTION

Accordingly, it is an object of the present invention to provide a multi-pole plug connector which avoids the disadvantages of the prior art.

More particularly, it is an object of the present invention to provide a multi-pole plug connector, which makes possible, with structurally simple means and without loss of any poles, not only prevention of false interengagement of plug and socket parts with an equal number of respective poles, but also prevention of false interengagement of plug and socket parts with non-equal numbers of poles.

In keeping with these objects and with others which will become apparent hereinafter, one feature of the present invention resides, briefly stated, in a multi-pole plug connector which includes a strip having a plurality of plug parts or socket parts with different respective numbers of poles; a plurality of corresponding socket parts or plug parts respectively insertable into the strip; coding elements arranged in the plug parts and the socket parts, contours provided on the plug parts and the socket parts which cooperate in other than edge regions thereof, when the plug parts are plugged into the socket parts, the contours including projections and recesses and being arranged in correspondence with a pattern having a predetermined pattern spacing; the contours include corner edges deviating from the patterned contours so as to be purposely mismatched with the latter.

Because of the introduction of the contours of the plug parts and socket parts into the coding system, the patterned contours with the corner edges purposely deviating from the pattern having the predetermined pattern spacing can unobjectionably prevent a false interengagement of the plug parts and socket parts having non-equal respective numbers of poles. The reason is due to the fact that in such case at least one corner edge of the parts with the lower number of poles would collide with the patterned contour of the other part, and an assembly of the same would therefore not be possible. This coding is achieved without any loss of poles, it is structurally simple, and makes possible extrusion with simple tools in a simple manner.

In accordance with an especially advantageous feature of the present invention, which provides for a plurality of coding possibilities with the aid of such contours, both the cooperating contours provided on the upper surfaces, and the cooperating contours provided on the lower surfaces of the plug and socket parts have the above-mentioned pattern and corner edges deviating from the pattern design, while the contours on the upper surfaces are formed differently from the contours of the lower surfaces. In this case a very simple arrangement with very simple basic forms of the contours can be provided, for example in that the contours of the upper surfaces prevent false interengagement of plug parts having a higher number of poles with socket parts having a lower number of poles, while the contours of the lower surfaces prevent false interengagement of plug parts having a lower number of poles with socket parts having a higher number of poles.

In the above-described construction, the conventional coding elements used in the interengagement of the plug parts and socket parts are retained exclusively for the prevention of undesirable interconnection of plug parts and socket parts having equal respective numbers of poles.

The novel features of the present invention are set forth in particular in the appended claims. The invention itself, however, both as to its construction and its manner of operation, will be best understood from the following description of preferred embodiments, which is accompanied by the followiung drawings.

DESCRIPTION OF PREFERRED EMBODIMENTS

Figure 1:
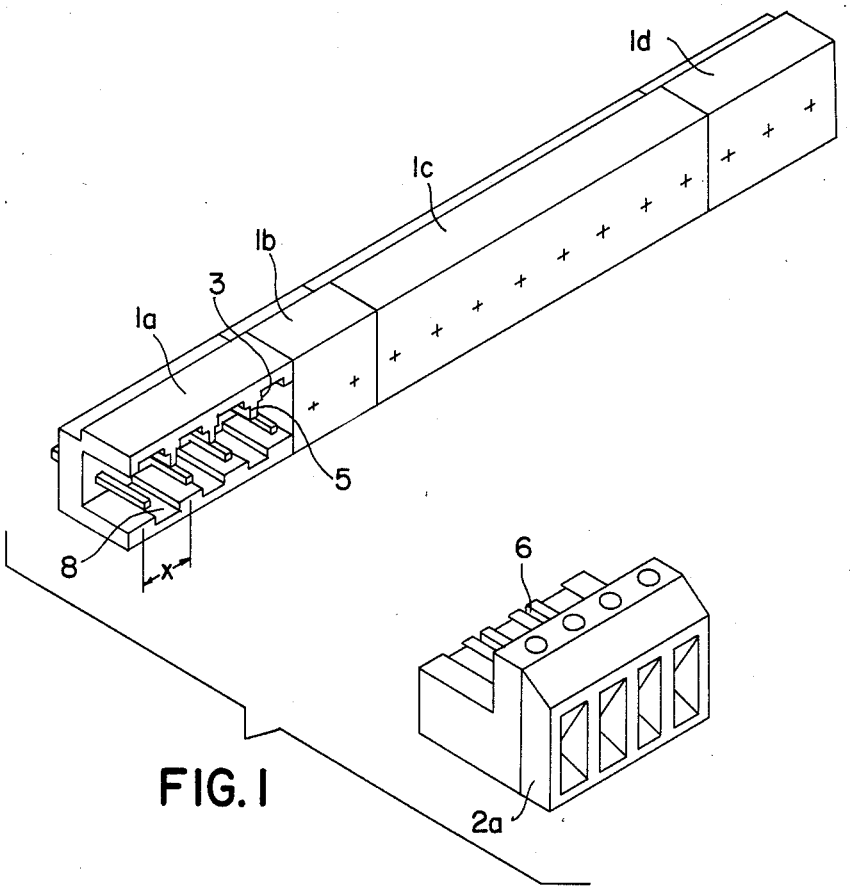
FIG. 1 is a partially schematic view of a multi-pole plug connector, in accordance with the present invention, with a plug strip having several plug parts of different respective numbers of poles, and associated socket parts.

FIG.1 shows a plug connector in accordance with the present invention, which has a plug strip with a high total number of poles. In the shown region, the strip is composed, for example, of one four-pole plug part 1*a*, one two-pole plug part 1*b*, one eight-pole plug part 1*c*, and one three-pole plug part 1*d* arranged in a row. Such plug strips can be formed, for example, on conductive plates. After the formation of the plug strip from the individual plug parts, the separating joints between the individual plug parts 1*a*, 1*b*, 1*c*, 1*d* etc. are hardly visible, so that the risk of any false plug connection of the corresponding socket parts is great.

Only one four-pole socket part 2*a* from the associated socket parts is shown in FIG.1 for the sake of simplicity. The requirement exists to make possible connection of plug parts and socket parts with equal respective number of poles, while avoiding false interengagement. There exists also the further requirement to prevent undesirable interengagement of the several plug parts provided in one strip, and socket parts of the same number of poles by coding means.

As can be seen from the drawings, for preventing false interengagement of plug parts and socket parts with non-equal number of poles, the plug parts and the socket parts are provided with contours which cooperate when the plug parts and the socket parts are connected to one another, and include respective projections and grooves which follow a predetermined pattern spacing. However, the corner edges of the contours deviate from the pattern spacing so that the corner edges are collidable with, or are purposely mismatched in relation to the patterned contours.

In the shown embodiment the plug parts 1*a*, 1*b*, 1*c*, 1*d*, and the socket parts 2*a*, 2*b*, 2*c*, 2*d* are provided on their outer cooperating contours with insertion recesses 3, which follow a predetermined pattern spacing (x) and after assembly, face toward one another with each being open toward a corresponding counterpart. The insertion recesses 3 are provided for insertion of coding elements 4 therein. For preventing false interengagement of plug parts and socket parts of non-equal number of poles, the contours of the plug parts 1*a*, 1*b*, 1*c*, 1*d* are provided in this embodiment in their central region with projecting ribs 5. The ribs 5 are located between the insertion recesses 3 and follow the same pattern spacing (x). On the other hand, the socket parts 2*a*, 2*b*, 2*c*, 2*d* are provided at corresponding places with grooves 6 for receiving the ribs 5.

The corner edge regions of the above-mentioned contours, which include the ribs 5 and the grooves 6, or in other words the regions in which the plug parts and the socket parts end in correspondence with their number of poles, deviate from the patterned contours so as to collide with, or be purposely mismatched with the latter. For example, in the shown embodiment the upper corner edges of the socket parts 2*a*, 2*b*, 2*c*, 2*d* are formed solid, despite the fact that if one followed the pattern spacing (x), partial recesses corresponding to a partial region of the groove 6 would be provided there.

Prevention of false interengagement in the sense of coding is further achieved in the shown embodiment by contours which are provided on lower surfaces of the plug parts 1*a*, 1*b*, 1*c*, 1*d*, and the socket parts 2*a*, 2*b*, 2*c*, 2*d*, and which include projections and recesses and corner edges designed for collision, or purposely mismatched with the patterned contours. This is accomplished, for example, by the contours on the lower surfaces having different geometrical shapes than the cooperating contours on the upper surfaces. This forestalls any additional false interengagement possibilities. In the shown embodiment, the socket parts 2*a*, 2*b*, 2*c*, 2*d* are provided in their central region with relatively wide ribs 7, while the plug parts 1*a*, 1*b*, 1*c*, 1*d* are provided with corresponding grooves 8. The ribs 7 and the grooves 8 also follow the pattern spacing (x). The total arrangement is selected so that in the socket part one groove 6 at the upper side is located opposite and below a corresponding rib 5, while in the plug part one rib 5 at the upper side is located opposite a corresponding groove 8.

Various possibilities for prevention of false interengagement of plug parts and socket parts with different respective numbers of poles are illustrated in the drawings. The collision regions which prevent false interengagement are identified as black surfaces.

Figure 2:
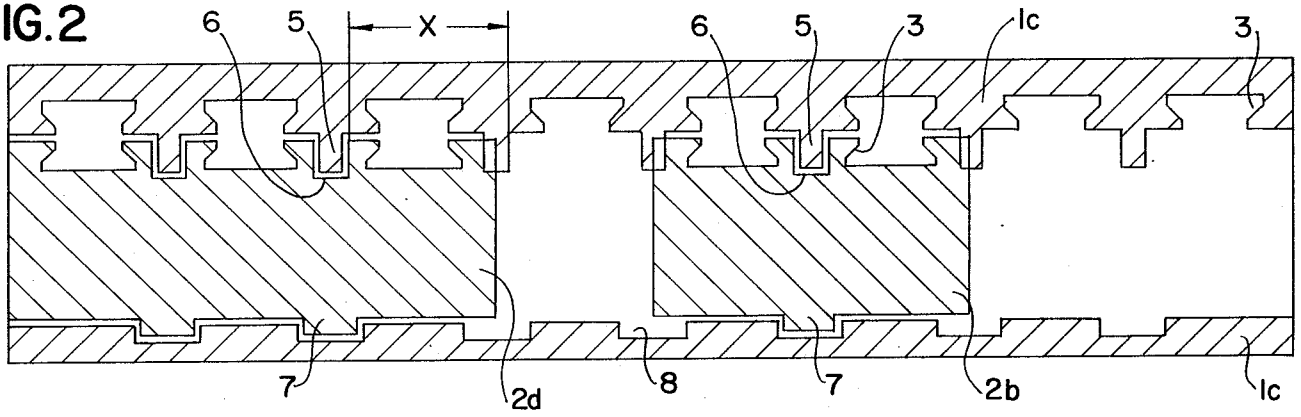
FIG. 2 is a view showing the inventive plug connector with an eight-pole plug part and illustrating prevention of any false interengagement with a three-pole and a two-pole socket part.

As shown in FIG. 2, it is, for example not possible to insert the two-pole and/or the three-pole socket part 2*b* or 2*d* into the eight-pole plug part 1*c*. The reason is that in this case at least one corner region of the contour of the socket parts 2*b*, 2*d* would collide with the rib 5 of the contour on the upper side of the plug part 1*c*, and a matching fit at this region would not be possible.

Figure 7:
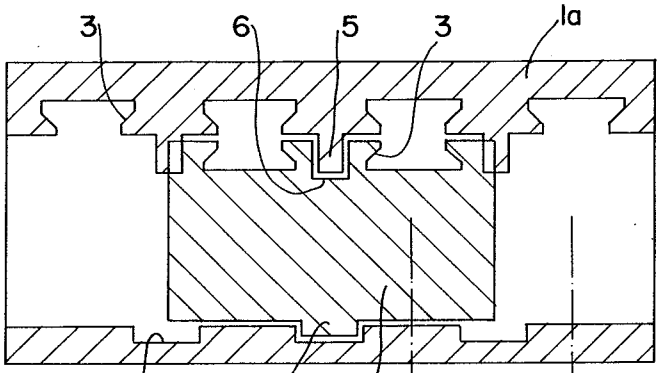
FIG. 7 is a view showing the inventive plug connector with a four-pole plug part and further illustrating the prevention of false interengagement with a two-pole socket part.
Figure 6:
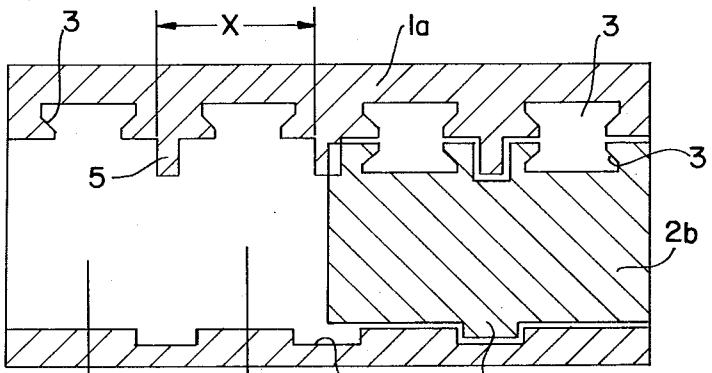
FIG. 6 is a view showing the inventive plug connector with a four-pole plug part and illustrating the prevention of false interengagement with a two-pole socket part.

FIGS. 6 and 7 show that it is, for example, not possible to insert a two-pole socket part 2*b* into the four-pole plug part 1*a* either in the central region, nor starting from an edge. This is so because in each case at least one corner edge on the upper surface of the socket part 2*b* would have to collide with the rib 5 of the contour at the upper surface of the plug part 1*a*.

In accordance with the system of this embodiment, the contours on the cooperating upper surfaces of the plug parts and the socket parts are designed for preventing false interengagement of parts with different respective numbers of poles for the case when it is attempted to erroneously insert the socket parts with a lower number of poles into the plug parts with a higher number of poles.

Figure 4:
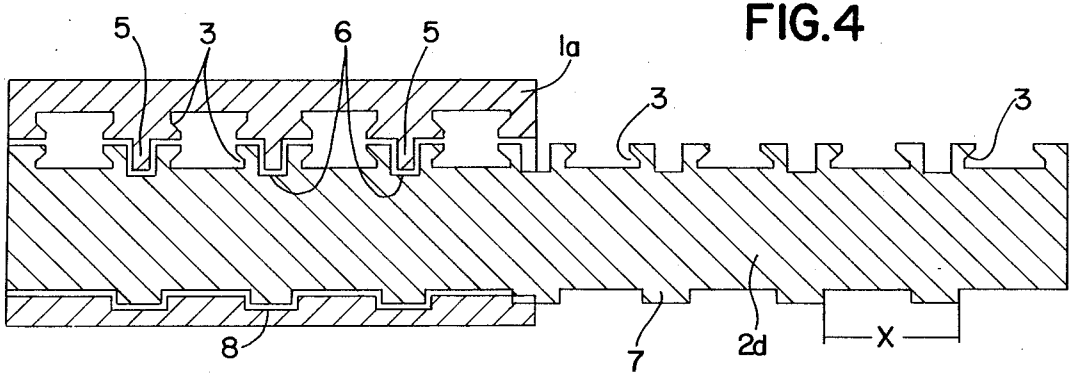
FIG. 4 is a view showing the inventive plug connector with a four-pole plug part and illustrating the prevention of false interengagement with an eight-pole socket part.

FIG. 4 shows that, for example, an eight-pole socket part 2*d* cannot even be partially inserted into a four-pole plug part 1*a*. The reason is that here, in the cooperating lower surfaces of the plug parts and socket parts, the regions of the corner edges of the contours deviate from the patterned contours. In the shown example, in the region of the corner edges of the lower surfaces of the plug parts 1*a*, 1*b*, 1*c*, 1*d*, in contrast to the pattern spacing, no recesses are provided which are similar to the groove 8 in the partial region following the pattern interval. On the lower surfaces of the socket parts, no ribs 7 in the regions of the corner edges are provided. As can be seen from FIG. 4, in any case at least one rib 7 of a larger socket part, for example the eight-pole socket part 2*d*, would have to collide with the solid corner edge of a smaller plug part, for example a four-pole plug part 1*a*.

Figure 3:
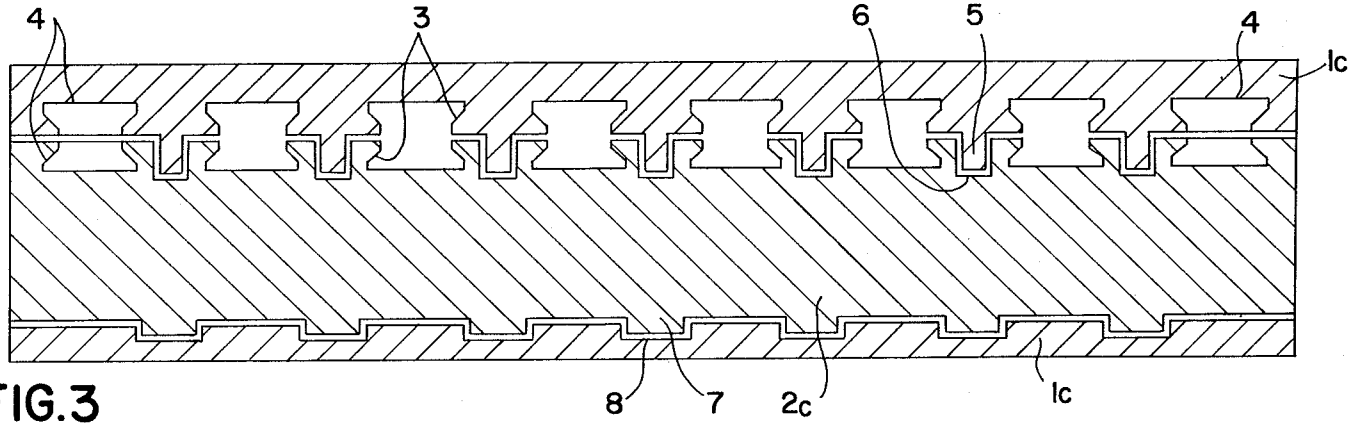
FIG.3 is a view showing the inventive plug connector with an eight-pole plug part and an eight-pole socket part and illustrating the prevention of false interengagement by inserted coding elements.
Figure 5:
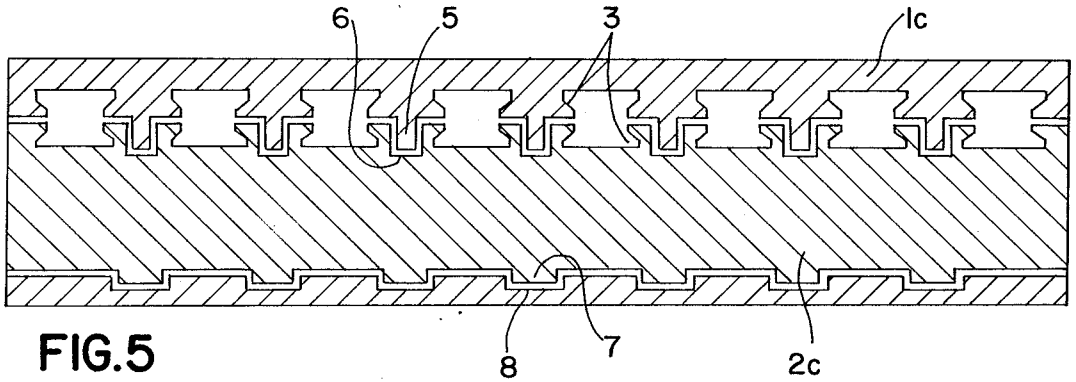
FIG. 5 is a view illustrating the desired plug connection between an eight-pole plug part and an eight-pole socket part, without the use of inserted coding elements.
Figure 8:
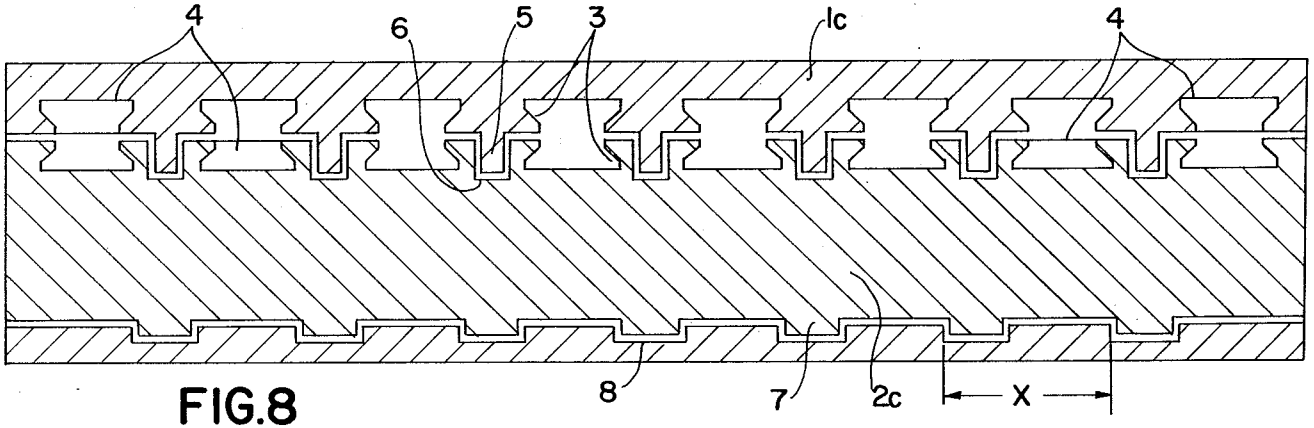
FIG.8 is a view showing the inventive plug connector with an eight-pole plug part with a desired plug connection with an eight-pole socket part, and with the use of inserted coding elements.

FIGS. 3, 5, 8 illustrate the possibility of preventing undesirable interengagement in this system of plug parts and socket parts with equal numbers of poles, with the utilization of conventional coding elements 4. FIG. 5 shows the possibility of connecting the eight-pole plug part 1*c* with the eight-pole socket part 2*c* in a matching or collision-free manner, while these parts remain uncoded.

FIG. 3 illustrates that it is possible to block the plug connection between the eight-pole plug part 1*c* and the eight-pole socket part 2*c*, by corresponding coding elements 4 which are inserted into corresponding insertion recesses 3.

FIG. 8 illustrates the case with the basic use of the coding elements 4, but in which the plug part 1*c* and the socket part 2*c* are coded by correspondingly offset insertion of the coding elements 4 as a compressible, mutually adjusted pair.

The above-described embodiments show a plug strip composed of plug parts arranged in a row, and socket parts engaging in the plug strip. It is to be understood that this arrangement can be reversed in that the socket parts with different respective numbers of poles can be assembled into a long socket strip, and then the plug parts with corresponding number of poles can be inserted into the strip.

The upper surfaces and the lower surfaces of the plug parts and socket parts can be provided with contours of different respective geometrical shapes, which for achieving the objects of the present invention, can include all simple geometrical shapes. It is further possible, in deviation from the shown embodiments, to provide grooves at the places of the ribs, and then to provide ribs in the corresponding counterpart.

The invention is not limited to the details shown, since various modifications and structural changes are possible without departing in any way from the spirit of the invention.

What is desired to be protected by Letters Patent is set forth in particular in the appended claims.

I claim:

1. A multi-plug connector, comprising in combination a strip including a plurality of plug parts or socket parts provided with different respective numbers of poles and arranged in a side by side assembly;

a plurality of corresponding socket parts or plug parts each having a different number of poles and each one individually and apart from the other ones, being insertaable into said strip to mate with a socket or plung part at a location along said strip having the same number of poles;

a plurality of insertion recesses provided in mating ones of said plug parts and said socket parts for inserting coding elements therein, and contours provided on said plug parts and said socket parts which cooperate with one another in other than edge regions thereof, when said plug parts are plugged into said socket parts, said contours including projections and recess which are arranged in correspondence with a regular pattern having a predetermined pattern spacing and interfitting when an insertable plug or socket part is mated with an appropriate plug or socket part of said assembly of said strip;

said contours including corner edges deviating from said contours of said regular pattern so as to be purposely mismatched and non-fittingly collidable with the latter to prevent incorrect matching of an insertable plug or socket part with a plug or socket part of said assembly of said strip having a different number of poles.

2. A multi-pole plug connector as defined in claim 1, wherein said plug parts and said socket parts have upper and lower surfaces, said projections and recesses arranged in correspondence with said regular pattern and said deviating corner edges being provided on said upper surfaces and on said lower surfaces, said projections and recesses arranged in correspondence with said regular pattern being formed differently on said upper surfaces and on said lower surfaces.

3. A mult-pole plug connector as defined in claim 1, wherein said plug parts and said socket parts have upper surfaces provided with said projections and grooves arranged in correspondence with said regular pattern, said projections on said upper surfaces being formed as ribs arranged in a central region of said upper surfaces of said plug parts, said recesses on said upper surfaces being formed as receiving grooves arranged in a central region of said upper surfaces of said socket parts, said deviating corner edges being formed to be solid without any grooves and different from said regular pattern.

4. A multi-pole plug connector as defined in claim 3, wherein said insertion recesses are arranged in said plug parts and said socket parts in correspondence with said regular pattern between said ribs and said receiving recesses, said insertion recesses facing toward one another and being open toward one another for inserting coding elements therein into said insertion recesses.

5. A multi-pole plug connector as defined in claim 2, wherein said projections and said recesses are formed as ribs and grooves, respectively, said ribs and grooves on said lower surfaces having a size which is different from that of said ribs and grooves on said upper surfaces, but which nevertheless follow said regular pattern, said corner edges of said plug parts being formed to be solid without any grooves and different from said regular pattern.

6. A multi-pole plug connector as defined in claim 3, wherein said grooves of said upper surfaces on said socket parts are located opposite to said ribs located on said lower surfaces, while said ribs of said upper surfaces on said plug parts are located opposite to said grooves formed in said lower surfaces.

7. A multi-pole plug connector as defined in claim 5, wherein said grooves of said upper surfaces on said socket parts are located opposite to said ribs located on said lower surfaces, while said ribs of said upper surfaces on said plug parts are located opposite to said grooves formed in said lower surfaces.

* * * * *